United States Patent [19]

Herrington

[11] Patent Number: 4,584,820

[45] Date of Patent: Apr. 29, 1986

[54] INDIVIDUAL BAG FOLDER AND CARTON LOADER AND METHOD FOR OPERATION THEREOF

[75] Inventor: Fox J. Herrington, Holcomb, N.Y.

[73] Assignee: Mobil Oil Corporation, New York, N.Y.

[21] Appl. No.: 727,202

[22] Filed: Apr. 29, 1985

Related U.S. Application Data

[63] Continuation of Ser. No. 329,371, Dec. 10, 1981, abandoned.

[51] Int. Cl.[4] ..... B65B 63/04

[52] U.S. Cl. ..... 53/429; 53/117

[58] Field of Search ..... 53/429, 447, 117; 493/179, 438, 447, 448, 456, 457

[56] References Cited

U.S. PATENT DOCUMENTS

| | | | |
|---|---|---|---|
| 1,708,534 | 4/1929 | Christman | 493/457 X |
| 1,909,050 | 5/1933 | Ferguson | 53/429 |
| 2,785,669 | 3/1957 | Billeb | 493/438 X |
| 3,919,827 | 11/1975 | Larson | 53/429 |
| 4,008,887 | 2/1977 | Karolyi | 493/457 |
| 4,037,386 | 7/1977 | Stoman | 53/429 |
| 4,218,962 | 8/1980 | Cunningham | 53/117 X |

FOREIGN PATENT DOCUMENTS

| | | | |
|---|---|---|---|
| 2356877 | 5/1975 | Fed. Rep. of Germany | 53/117 |
| 2742260 | 4/1978 | Fed. Rep. of Germany | 53/117 |

*Primary Examiner*—John Sipos

*Attorney, Agent, or Firm*—Alexander J. McKillop; Michael G. Gilman; Charles J. Speciale

[57] ABSTRACT

A reciprocative apparatus individually folds a plurality of thin, limp, sheet-type articles, such as sandwich bags, and loads them into a carton. The apparatus may include a delivery assembly for sequentially transferring the bags from a conveyor belt to a folding station. A pivotally operated swatter is described for such delivery.

The folding station includes a pair of trays forming a platform and a pair of flippers for sequentially folding end portions of a bag upon its middle portion. The initially operated flipper is operated by a pneumatic cylinder. The secondarily operated flipper is connected to a carrier assembly which is supported by springs attached to a frame. Another pneumatic cylinder is also connected to the carrier assembly and to the second flipper through a linkage. When retracted, its cylinder rod attempts to pull down the cylinder assembly, but the spring force is sufficiently great that it is easier for the second flipper to pivot to a horizontal position, as determined when a link member contacts a stop within its flipper arm.

Then, as the cylinder rod continues to pull downwardly, it overcomes the force of the springs and moves the carrier assembly downwardly, causing the trays to move downwardly and sidewardly while the second flipper quickly pushes the folded bag toward the bottom of a carton disposed therebeneath and suitably on a conveyor. The spring force may also be adjusted to provide a packing force for "stomping" the folded bags into the carton. Upon reversal of the cylinder, the second flipper rises and then pivots as the trays revolve inwardly to re-establish the platform for receiving the next bag.

21 Claims, 17 Drawing Figures

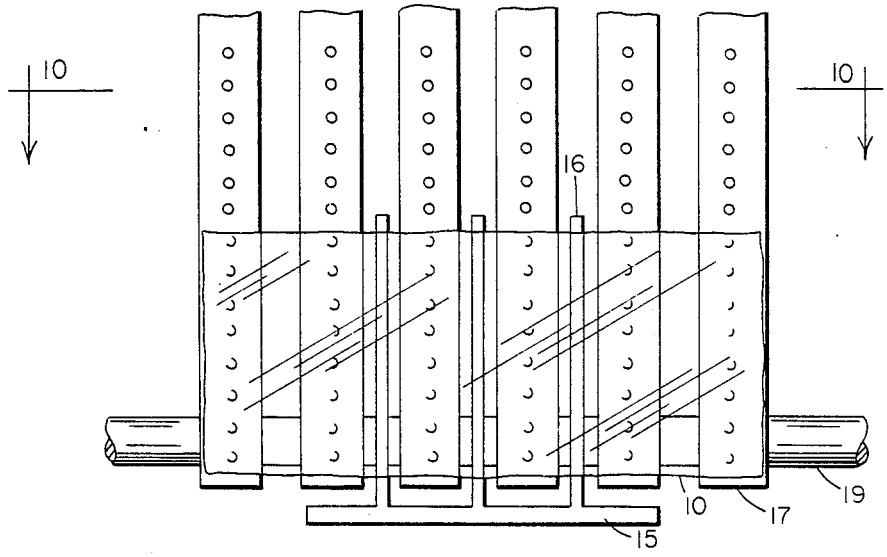
FIG. 9
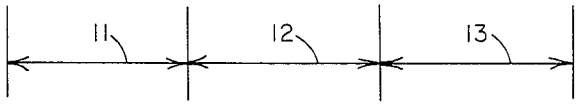
FIG. 10
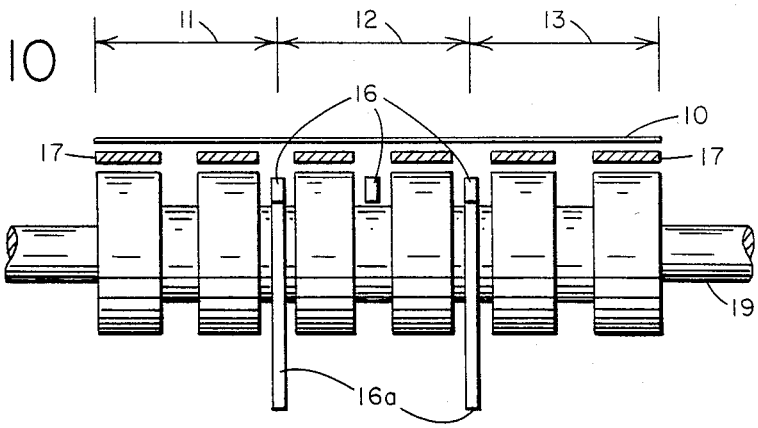

INDIVIDUAL BAG FOLDER AND CARTON LOADER AND METHOD FOR OPERATION THEREOF

This is a continuation of copending application Ser. No. 329,371, filed on Dec. 10, 1981, now abandoned.

BACKGROUND OF THE INVENTION

This invention relates to folding and loading of thin, limp, sheet-type articles into a receptacle therefor and particularly relates to folding and loading of small plastic bags, such as sandwich bags, into a dispensing box or carton.

Plastic sheet materials present many handling and dispensing problems which are magnified when the sheet is thin, limp, and subject to loading by static electricity. Exemplary plastic sheet materials which are used in large quantities at the present time are plastic bags, such as trash bags, produce bags, and sandwich bags. Many of these bag products are assembled, shipped, and dispensed in roll form. Others, however, are preferably handled in folded form because of consumer preferences, economy in storage, and/or ease of handling and dispensing. Folding of such bags can be performed by in-line machinery without great difficulty when the bags are large, as, for example, bulk bags and trash bags.

However, when the bags are quite small, such as sandwich bags, for example, so many difficulties occur with presently available machinery that the present practice is to use manual labor for folding and loading plastic sandwich bags into dispensing boxes therefor. There is consequently a need for new concepts and arrangements that will overcome the specific problems peculiar to folding and loading of such thin plastic articles of relatively small size. These difficulties arise because the bags must be sequentially picked up from a conveyor, folded, folded again, transported to a receptacle, loaded into the receptacle, and pressed against its bottom in order to remove entrapped air. In each of these operations, the lightness, limpness, thinness, and smallness of the bags present special handling problems, particularly when static electricity is present. Simply scaling down conventional folding machines does not solve these problems because the prior art devices inherently rely upon significantly greater stiffness, bulk, basis weight, and like properties.

A method for sequentially packaging flexible plastic refuse bags is taught in U.S. Pat. No. 3,842,568 which comprises reeling a bag onto a mandrel, pulling it sidewise in reeled condition from the mandrel, and tamping the reeled bag into a carton.

An apparatus is described in U.S. Pat. No. 3,918,699 for multiple folding of soft articles, such as textile and paper articles. It includes a plurality of cooperating longitudinal and transverse folding arms which are operable according to a predetermined sequence and which cooperate with folding plates. More specifically, the middle portion of an article to be folded is brought under a folding plate while its side portions lie on the longitudinal side folding arms of the machine. The side folding arms then operate toward each other in sequence so they form two folds and longitudinally overlap the two side portions. This prefolded article is next delivered to a second folding station where transversely disposed folding arms sequentially perform similar single foldings. The longtudinally and transversely folded article is finally delivered to a stacking station.

An apparatus and method for folding textile materials is taught in U.S. Pat. No. 4,008,887. It comprises a plurality of pivotal folding flap plates for sequentially folding the material while gripping devices at the movable plates prevent unfolding and/or shifting of the material. The gripping members are C-shaped fingerlike elastic elements mounted on rotatable gripper shafts which are connected to rotatable flexible shafts and to a control mechanism for sequentially controlling the rotation of the shafts.

SUMMARY OF THE INVENTION

It is accordingly an object of this invention to provide a method and an apparatus for picking up a plurality of thin, limp, sheet-type articles from a conveyor, folding the articles, and sequentially loading the folded articles into a receptacle therefor.

It is also an object to provide a movement means for partially folding each sheet article while delivering it from the conveyor to a folding station.

It is further an object to provide a removable support means, as a part of the folding station, which is aligned with the receptacle.

It is additionally an object to provide a loading means which removes the support means while propelling the folded article toward and against the bottom of the receptacle.

It is still further an object to provide a packing means which pushes each folded article against the bottom of the receptacle with a selected force.

According to these objectives and the principles of this invention, an apparatus is herein provided for sequentially delivering, folding, and loading a plurality of thin, limp, sheet-type articles into a receptacle or carton, after these articles have been sequentially conveyed to a pick-up station, and for packing the loaded articles within the carton.

This apparatus comprises a folding and loading assembly which is operable separately from the delivering assembly and which may indeed be combined with a wide variety of delivering devices. The apparatus for folding and loading a plurality of sequentially delivered thin, limp, sheet-type articles into a receptacle therefor, such as a carton, comprises:

A. a folding station, comprising:
  (1) a removable platform, as the bottom of the folding station,
  (2) a folding means, which is in standby position and alongside the platform when the article is delivered onto the platform, for sequentially folding at least one portion of such an article onto another portion thereof; and B. a loading assembly for sequentially loading each folded article into a carton having a bottom, this bottom being aligned with and transversely spaced from the folded article on the platform and this loading assembly comprising:
  (1) a propulsion means for:
    (a) in a first movement, pivotally operating the folding means to perform the folding and transversely moving the folding means and therewith propelling the folded article toward the bottom of the carton, while moving the platform away from the folding station, and then packing the folded article toward the bottom of the carton with a selected packing force, and (b) in a second movement transversely returning the folding means and the platform to the folding station and pivotally returning the folding means to its standby position, (2) a support and guide means for supporting the folding station, guiding the moving of the platform, guiding the pivotal folding of the folding means, and guiding the transverse propelling of the folding means, and (3) a biasing means for separating the the pivotal folding and returning of the folding means to its standby position from:

(a) the moving and returning of the platform and (b) the transverse propelling and returning of the folding means, during both movements by supporting a part of the support and guide means and by providing an additional selected force that is directed oppositely to the propelling of the folded article.

The support and guide means comprise two parts:

A. a fixed part which supports a means for removing the platform, such as pivotally, and further guides the biasing means, and B. a movable part which supports the weight of the platform, the weight of the folding means, and a means for pivoting the folding means.

In addition, the movable part utilizes guides for the transverse propelling and return movements of the folding means. The biasing means supports the weight of the movable part, thereby performing its separating function. The propulsion means is connected to the movable part so that the beginning of its first movement firstly pivots the folding means into parallelism with the platform. At this point, the propulsion means overcomes the selected residual force of the biasing means and in a continuous movement, while simultaneously pivoting the platform to an out-of-the-way position, propels the folding means transversely toward the bottom of the carton, thereby rapidly pushing the folded article downwardly, and finally pushes the folding means toward the bottom of the carton with the selected packing force, so that all loaded articles are packed against the bottom of the carton. The sequence is reversed in the second or return movement of the propulsion means.

The removable platform may be a single tray or a pair of side-by-side trays which are simultaneously pivoted away from or toward the folding station. The folding means is aligned with at least one side of the platform or is paralell with the outside edge of at least one of the trays.

The fixed part of the support and guide means also contains adjustable stops which interact with the movable part to control the return position of the folding means and the extent of pivoting of the folding means toward and away from the platform.

If the thin, limp, sheet-type article need be folded no more than once, a single folding means is sufficient. In the form of a pivotable flipper alongside one tray or a pair of trays forming the platform, the flipper may await delivery of the article to be folded while disposed horizontally in side-by-side relationship with the tray or trays, to create an extended platform, or may be disposed at other angles, such as approximately a right angle thereto so that the folding station is L-shaped.

If the thin, limp, sheet-type article is to be folded twice, a pair of folding means, such as a pair of pivotable flippers, is suitably used on each side of the platform. One or both flippers may be parallel with the tray or trays, i.e., disposed horizontally to form an extended platform, or they may both be disposed at other angles, such as approximately 90° to the platform, so that the folding station is U-shaped.

The delivery means is suitably in the form of a delivery assembly utilizing a swatter, and the folding means can be a folding assembly including a pair of trays and a pair of flippers to perform two sequential foldings. The propulsion means can also be considered to be a part of a loading assembly. Thus analyzed, the apparatus comprises:

A. a delivery assembly for sequentially delivering the articles to a folding station, comprising:

(1) a pivotable swatter, having a pair of end members which are perpendicularly disposed to the axis of revolution of the swatter and which is arranged to be athwart and beyond each article when the article has arrived at the pick-up station, so that the article is lengthwise divided by the end members into three parts, and (2) a first actuator means for rigidly pivoting the swatter through the arc of at least about 90°, whereby the article is delivered to the folding station with a middle portion supported by the swatter and with first and second end portions partially folded beyond the end members because of the inertia of the end portions;

B. a folding assembly for sequentially folding the articles, comprising:

(1) a removable flat platform which is adapted to receive the middle portion, (2) a pair of pivotable flippers which are disposed approximately perpendicularly to the platform when in article-receiving position and are spaced apart by about one-third the length of the article to form the folding station, in combination with the platform, as a U-shaped channel, (3) a second actuator means for pivoting one flipper through about 90° to lay the first end portion of the article onto the middle portion and for returning the flipper to the article-receiving position or standby position, (4) a third actuator means for pivoting the other flipper through about 90° to lay the second end portion of the article onto the first end portion, whereby the article is fully folded, and for returning the other flipper to its article-receiving position after loading and packing are completed; and C. a loading assembly for loading the fully folded articles into the carton, having a bottom which is aligned with the folded articles, and for packing the articles against this bottom with a selected force, comprising:

(1) a platform-moving means for sidewardly moving the platform beyond the folding station, and return thereof, (2) a propulsion means for transversely moving the other flipper and the fully folded article toward the bottom of the carton and returning the other flipper to the folding station after packing against the bottom is completed, and (3) a packing means for exerting a selected packing force upon the fully folded article and against the bottom to accomplish the desired packing before the returning movement.

Because a biasing means separates pivoting the other flipper (B,4) from sideward movement of the flat platform (C,1), transverse movement of the other flipper (C,2), and exertion of the selected packing force (C,3), the apparatus is able to combine the third actuator means, the platform-moving means, the propulsion means, and the packing means into a single cylinder and its cylinder rod which is connected to the other flipper with a guiding and support means. The biasing means comprises at least one spring which supports the other flipper and the carrier member, to which the other flipper is pivotally connected, until pivoting of the flipper is completed and thereafter permits transverse movement of the pivoted flipper to occur.

The flat platform is pivotally connected to a carrier member which is connected to the cylinder rod, whereby initiation of the transverse movement effectuates the sideward movement of the flat platform.

The delivery assembly may alternatively be a cylinder and cylinder rod which are disposed in parallel to and aligned with the U-shaped channel and with the pick-up station. The cylinder rod has a pick-up device comprising vacuum-equipped prong members which are disposed athwart the article while overlying it at the pick-up station. The device additionally comprises a pair of vacuum-equipped wing members, each wing being pivotally connected at one end to a prong. In operation, the prongs pick up and hold the middle portion of the thin, limp, sheet-type article while the wing members engage the end portions thereof. While the cylinder rod is quickly extended, the wing members pivot upwardly. The partially folded article is thereby delivered in a straight sideward motion into the U-shaped channel of the folding assembly.

As another alternative, the delivery assembly may be an upside-down conveyor belt which is equipped along its bottom reach with a vacuum means while passing between the pick-up station and the folding station. At the point of delivery above the folding station, air blasts of selective magnitude can be used to direct the article into the U-shaped channel. Instead of merely dropping or blasting the article into the U-shaped channel, however, the conveyor belt may be adapted to descend or pivot downwardly into close proximity with the U-shaped channel just before the article is released and then to rise or pivot upwardly to a position beyond the sweep of the flippers.

The removable platform may be constructed as a single tray forming the bottom of the U-shaped channel (Step B,2) which is revolved sideways in Step C,1. Alternatively, this platform may be a pair of narrower trays which are disposed in side-by-side relationship and which sidewardly revolve away from each other in Step C,1.

The invention may alternatively be described as an apparatus comprising a double-function means for utilizing a singly and linearly applied force in order to perform a pivoting movement and then a linear movement, wherein the pivoting movement accomplishes the folding and the linear movement accomplishes the loading and packing. This double-function means comprises a biasing means for separating the pivoting movement from the linear movement and for additionally supporting a portion of the apparatus.

The apparatus further comprises a frame and a guide rod attached thereto. The supported apparatus portion approximately comprises all of the double-function means except a cylinder and its cylinder rod for exerting the linearly applied force. The supported apparatus portion more particularly comprises:

A. a rigid carriage assembly, comprising:
  (1) a cylindrical collar which coaxially surrounds the guide rod and contains at least one bushing, and
  (2) a plate member which is rigidly attached to the collar;
B. a rocker arm having two ends, which is pivotally attached to the plate member and to one end of which the cylinder rod is attached; and
C. a pivotable flipper which is pivotally attached to the plate member and to which the other end of the rocker arm is connected for performing the pivoting movement.

The supported apparatus portion further comprises a tray actuator bracket assembly which is rigidly attached to the carriage assembly and is pivotally connected to a pair of trays which are pivotally supported by the frame, whereby the linear movement revolvingly removes the pair of trays sidewardly.

With more attention to components, the apparatus of the invention for sequentially delivering and folding a plurality of plastic bags along a pair of parallel fold lines, after the bags have been conveyed to a pickup station, and for loading and packing the folded bags within a carton therefor, may be characterized as comprising:

A. a rigid frame which comprises a pair of spaced-apart guide rods and a base;
B. a swatter assembly, comprising:
  (1) a pivotable delivery swatter which comprises:
    (a) a straight shaft which is rotatable about its axis,
    (b) at least a pair of parallel prongs which are attached at one end to the shaft and are perpendicularly disposed thereto, the outermost of these prongs being spaced apart by the distance between the pair of parallel fold lines,
    (c) a plurality of support tines which are attached at one end to each outermost prong and are perpendicularly disposed thereto, whereby all of the support tines are in parallel and trailingly revolve within two spaced-apart planes of revolution which are defined by the parallel outermost prongs when the shaft rotates for delivering, and
    (d) a first movement means for rotating the shaft from the pickup station to a folding station and for rotatively returning to the pickup station;
C. a folding assembly, comprising:
  (1) a left flipper assembly which comprises:
    (a) a left flipper having a shaft, which is rotatably attached to the frame, and a plurality of left flipper tines which are perpendicularly attached at one end to the shaft, and
    (b) a left flipper cylinder which is attached to the frame and has a cylinder rod which is attached to the left flipper shaft for pivoting the left flipper from article-receiving position to folding position,
  (2) a right flipper assembly which comprises:
    (a) a right flipper having a shaft, which is rotatably attached at ends thereof to a pair of carrier arms, and a plurality of right flipper tines which are perpendicularly attached at one end to the right flipper shaft, the left flipper tines and the right flipper tines being sideways slightly beyond the planes of revolution when in article-receiving position, and
    (b) a flipper arm which is rigidly attached to the right flipper shaft, (3) a rigid carrier assembly which is slideably attached to the pair of guide rods and comprises the pair of carrier arms, and (4) a rocker arm assembly which is pivotally attached to the carrier assembly and to the flipper arm;

D. a stacking tray assembly, comprising a stacking platform having arms which are pivotally attached at one end to the frame;

E. a tray actuator bracket assembly, comprising a T-member, which is rigidly attached to the carrier assembly, and two tray links, each tray link being pivotally attached to the bracket assembly and to one end of a tray;

F. a linear movement means, for revolving the right flipper and for performing loading and packing, which is connected to the rocker arm assembly; and G. a biasing means which supports at least the combined weights of the right flipper assembly, the carrier assembly, and the rocker arm assembly and which additionally resists the force required for pivoting the right flipper, whereby the linear movement means becomes a dual-function means.

The carrier assembly comprises a pair of moving ball bushings which slideably surround the pair of guide rods, a pair of carrier support plates which are rigidly attached to cylinders enclosing the moving bushings, a carrier tie bar which is rigidly attached to the carrier support plates, and a rocker arm attachment bracket which is attached to the tie bar. The rocker arm assembly comprises a rocker arm which is pivotally attached between its ends to the rocker arm attachment bracket.

The linear movement means comprises a fluid-actuated cylinder and its cylinder rod which is pivotally connected to one of the ends of the rocker arm, the cylinder being attached to the base. The flipper arm is connected with a link member to the other end of the rocker arm and contains a stop surface for the link member which can be used to stop revolving of the right flipper when the right flipper tines are parallel to the pair of trays, after folding the second end portion of a bag against its middle portion and during the transverse movement to and from the carton.

A method is additionally provided for sequentially folding or loading a plurality of thin, limp, sheet-type articles, such as sandwich bags, into a receptacle, such as a dispensing carton or box, which comprises four sides and a bottom having side and end edges and selected dimensions, comprising the following steps:

A. partially folding each sandwich bag of the plurality of bags along two parallel fold lines, whereby the sandwich bag is divided into a first end portion, a middle portion having two side edges and the two fold lines, and a second end portion, the dimensions of the middle portion being no greater than the dimensions of the bottom of the carton;

B. depositing the sandwich bag onto supports of a folding station which is disposed in parallel to the bottom of the carton, whereby the side and end edges of the middle portion are aligned with the respective side and end edges of the bottom of the carton;

C. completely folding the first end portion onto the middle portion;

D. completely folding the second end portion onto the first end portion to form a folded bag which is spaced from, parallel to, and aligned with the bottom of the carton; and E. removing the supports and propelling the folded bag toward the bottom and into the carton.

In this method, the folded bag which is propelled into the carton in step E is additionally pushed into sequentially close proximity to the bottom so that the folded bags are forcibly stacked onto one another with a selected degree of tightness.

These supports of the folding station comprise a left side portion and a right side portion which move outwardly beyond two of the four sides of the carton in step E. The depositing of step B is performed in a pivotal movement in which the side edges revolve in parallel to the axis of the movement.

When the pivotal movement begins, the sandwich bag is resting on a conveyor of a sandwich bag-making machine. This pivotal movement begins by picking up the middle portion from the conveyor while supporting the middle portion on at least the two fold lines, whereby the first and second end portions trail behind the middle portion during the pivotal movement.

When the depositing occurs onto the supports of the folding station, the first and second end portions are disposed in approximately perpendicular relationship to the middle portion. This pivotal movement occurs through an arc of approximately 180° when the conveyor is disposed in approximately parallel relationship to the supports.

However, the pivotal movement occurs through an arc of approximately 90° when the conveyor is disposed in approximately perpendicular relationship to the supports. Of course, the conveyor can be disposed in any selective relationship between 0° and 180°, whereby the pivotal movement varies correspondingly. When the conveyor is disposed approximately perpendicularly to the supports, the bag is held approximately parallel to the conveyor by vacuum until the pivotal movement begins. Moreover, the first and second end portions are held in perpendicular relationship to the middle portion, with or without using vacuum, when the partially folded bag is resting on the folding station, until the folding of steps C and D respectively begin.

BRIEF DESCRIPTION OF THE DRAWINGS

The invention may be more clearly understood by referring to the following drawings, which show an apparatus which is suitable for carrying out the method of this invention.

FIG. 9 is a plan view of the pickup station at the end of a bag conveyor, with one bag positioned on the stopped conveyor and centered over the swatter prongs.

FIG. 10 is a sectional side elevation, looking in the direction of the arrows 10—10 in FIG. 9, which shows the conveyor shaft, conveyor belts, swatter prongs, swatter tines, and the bag lying on the belts.

DESCRIPTION OF THE EMBODIMENTS

Figure 1:
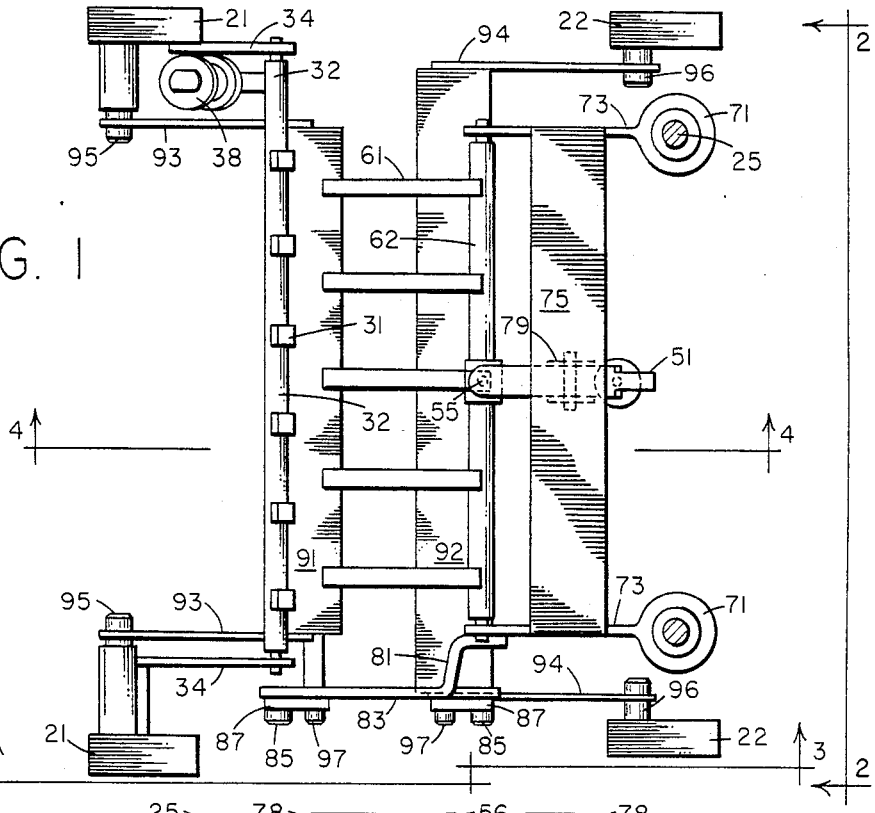
FIG. 1 is a plan view of the folder-loader assembly of the invention, with the right flipper in fold position.

The apparatus of this invention comprises sheet-delivering, sheet-folding, and folded-sheet loading assemblies, as shown in FIGS. 1–17, which sequentially remove a thin, limp article in sheet form from a conveyor, fold it into thirds, and pack the folded article within a receptacle, such as a box or carton. The sheet-folding and folded-sheet loading assemblies are described herein as a folder-loader assembly. FIGS. 12–17 illustratively show a sandwich bag as a suitable thin, limp, sheet-type article, but the apparatus is effective with sheet-type articles of any size if they are limp enough to be readily folded.

The sheet delivering assembly comprises a pivotable swatter having prongs 16 which nest at a pick-up station between conveyor belts 17 before a bag 10 reaches the pick-up station, as seen in FIGS. 9 and 10. Conveyor belts 17 stop as soon as a bag 10 arrives at the pick-up station, and shaft 15 thereupon rotates through an arc of 180°, if conveyor belts 17 are horizontally disposed, or through an arc of 90°, if conveyor belts 17 are vertically disposed, although other arcs are feasible, such as 135°. In the latter situation, it is generally desirable and sometimes necessary (depending on the size, weight, and limpness of the article) that vacuum orifices (not shown in the drawings) be disposed at the pick-up station, as is known in the art, in order to exert a slight holding force upon each bag 10 and maintain it in parallel to belts 17 before prongs 16 exert a separating force thereupon.

Figure 5:
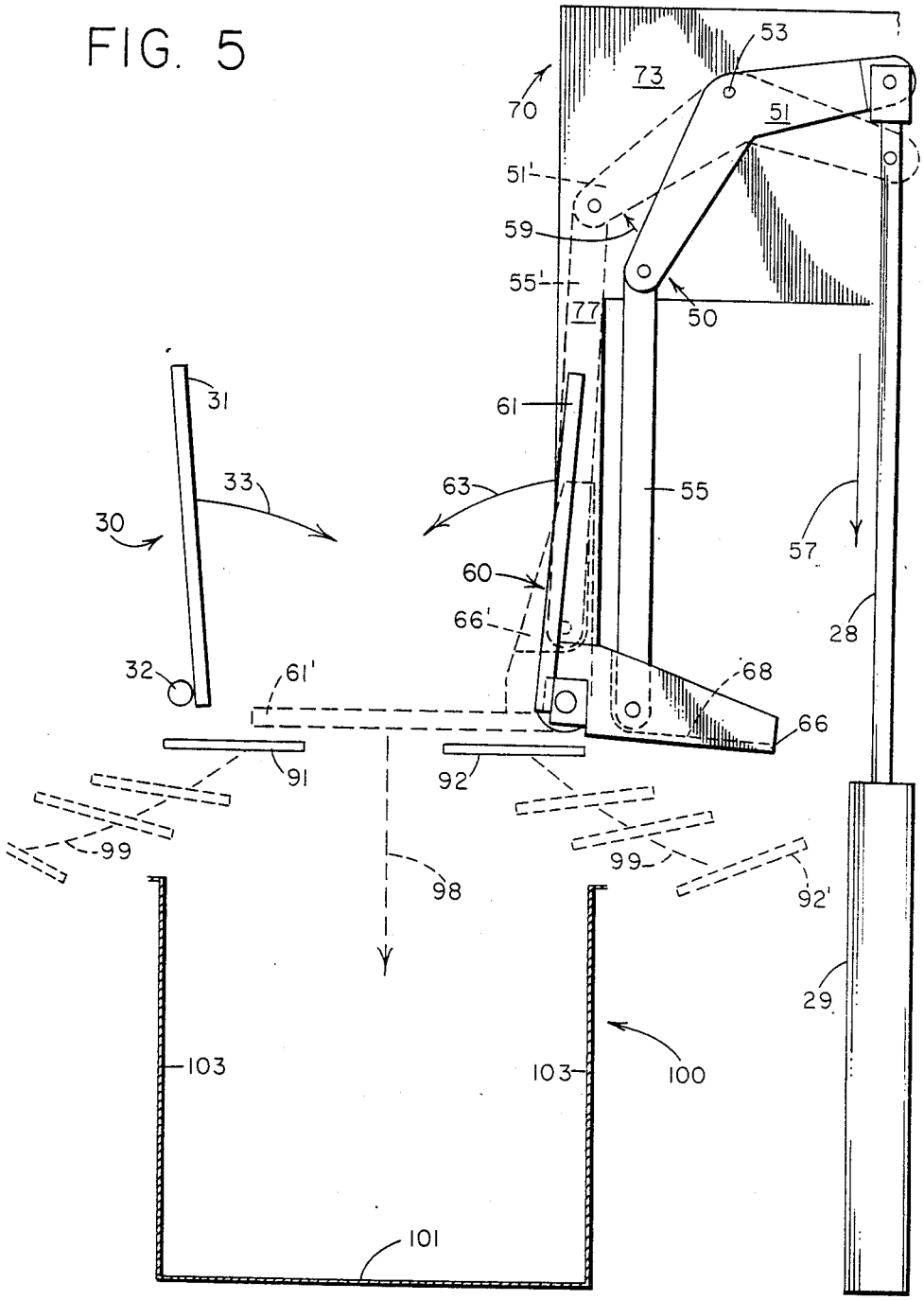
FIG. 5 is a partial sectional view, in elevation and similar to FIG. 4, showing the left and right flippers, the left and right trays, and the rocker arm assembly for pivoting the right flipper, and further showing the pivoted right flipper, right flipper arm and rocker arm in phantom view, with both trays also being in phantom view as they move beyond the carton therebeneath.
Figure 6:
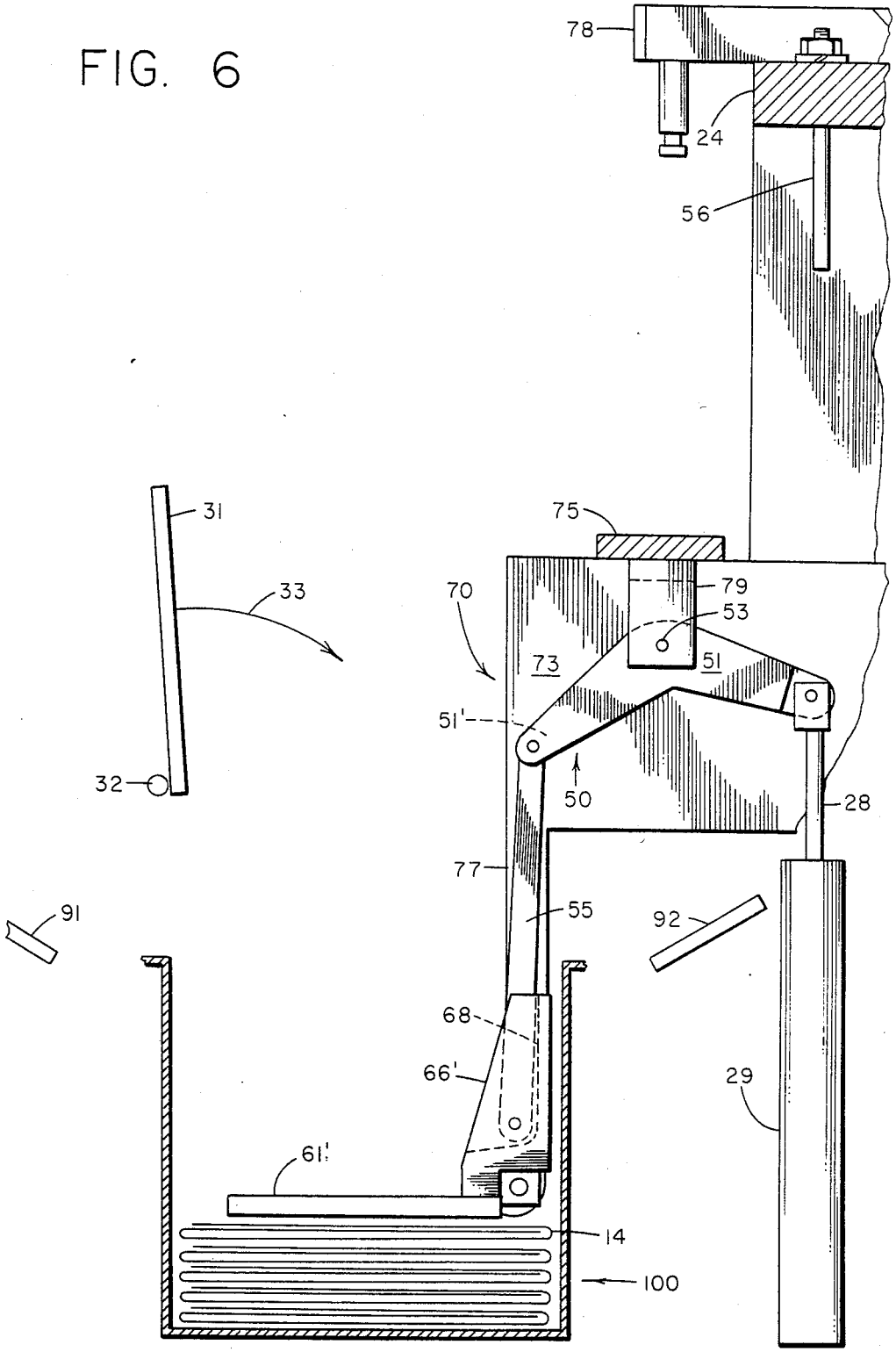
FIG. 6 is a partial sectional view, in elevation and similar to FIG. 5, showing the right flipper performing the packing operation after having loaded a folded bag into the carton and on top of several previously loaded and packed bags.
Figure 12:
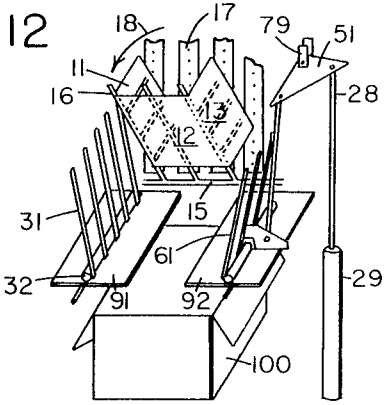
FIG. 12 is a partial perspective view of a carton being used as a receptacle, of a folding station above the carton which includes the left and right trays and the upright left and right flippers above the trays, and of a swatter which is pivotally delivering a partially folded sandwich bag, with its end portions trailing behind its middle portion which is supported by the swatter at the fold lines, from the conveyor and onto the trays between the flippers.
Figure 17:
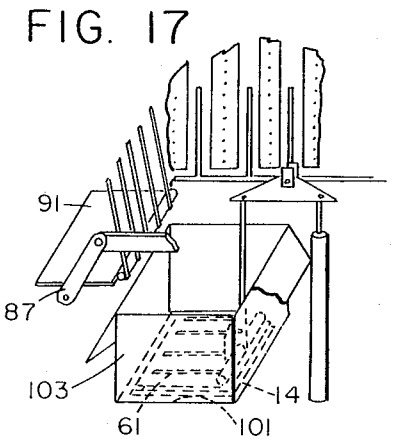
FIG. 17 is a perspective view, similar to FIGS. 12–16, which shows the right flipper pushing the folded bag against the bottom of the box.

Alternatively, a cylinder and cylinder rod having a pick-up device may be used as the delivery assembly, or an upside-down conveyor may be employed to deposit the picked-up article in the folding station seen most clearly in FIGS. 5 and 12.

This swatter lays between conveyor belts 17 of an article-delivering conveyor so that prongs 16 and support tines 16*a* are pivotally beyond each sheet-type article that arrives on conveyor belts 17 and are athwart the article. Moreover, when conveyor belts 17 stop, each article is initially divided into thirds by outer prongs 16, so that center portion 12 of the article is between the outermost prongs 16 and the first and second end portions 11,13 thereof are endwise beyond these prongs. The swatter is actuated by a cylinder (not shown in the drawings) so that shaft 15 rotates through an angle of 90°–180° to deliver the article to a folding station to be described hereinafter. After such delivery, the swatter pivots in the other direction to its waiting position beyond the surfaces of belts 17.

Figure 13:
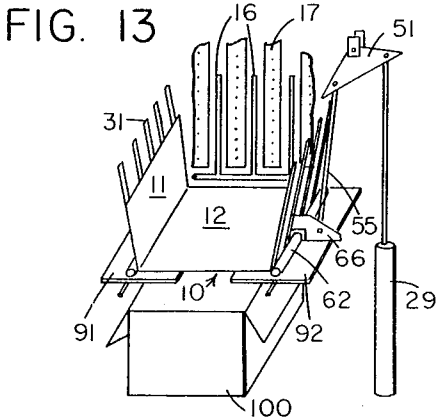
FIG. 13 is a perspective view, similar to FIG. 12, of the sandwich bag resting on the trays and between the flippers in partially folded position.

As visible in FIG. 12, prongs 16 cause bag 10 to be partially folded while it is revolving, because end portions 11,13 of bag 10 trail behind middle portion 12 at an angle of aproximately 90° and at least momentarily remain at this angle after arriving at the folding station, as a U-shaped channel which is formed by trays 91,92 and flipper tines 31,61. These end portions 11,13 remain at least momentarily upright against slightly diverging tines 31,61, while prongs 16 are pivoting in reverse toward the pick-up station, as seen in FIG. 13 after the reverse movement has been completed.

If it is necessary, however, depending upon the limpness of the material of bag 10, tines 31,61 and shafts 32,62 can be provided with passages therein which can be connected to a suction/pressure device for selectively producing a vacuum for holding portions 11,13 against tines 31,61 and then for producing positive pressure to separate end portions 11,13 from tines 31,61 after folding has been completed. Alternatively, vacuum devices can be disposed between tines 31,61.

The folder-loader assembly of this invention, as seen primarily in FIGS. 1–7, comprises a base 26, a pair of left vertical supports 21 which are rigidly attached to base 26, a left horizontal support 23 which is rigidly attached to top ends of supports 21, a pair of right vertical supports 22 which are rigidly attached to base 26, and a right horizontal support 24 which is rigidly attached to the top ends of supports 22. In combination, base 26, vertical supports 21,22, and horizontal supports 23,24 form a rigid frame which supports the folding, loading, and packing means of the folder-loader assembly of the invention.

Figure 2:
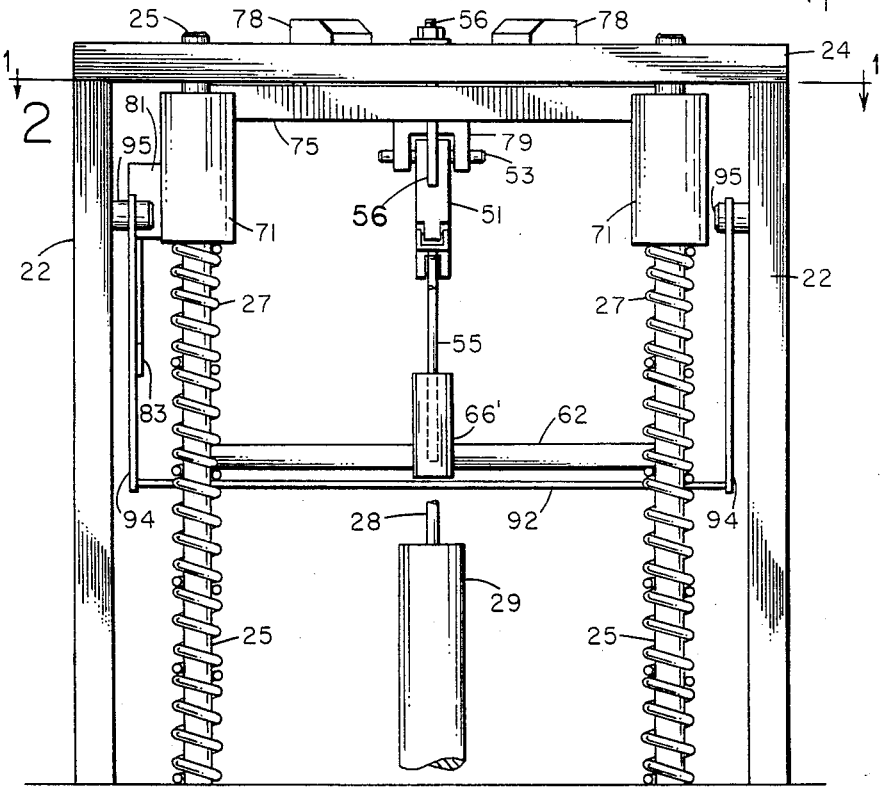
FIG. 2 is a side elevation view of the folder-loader assembly, looking in the direction of the arrows 2—2 in FIG. 1.
Figure 4:
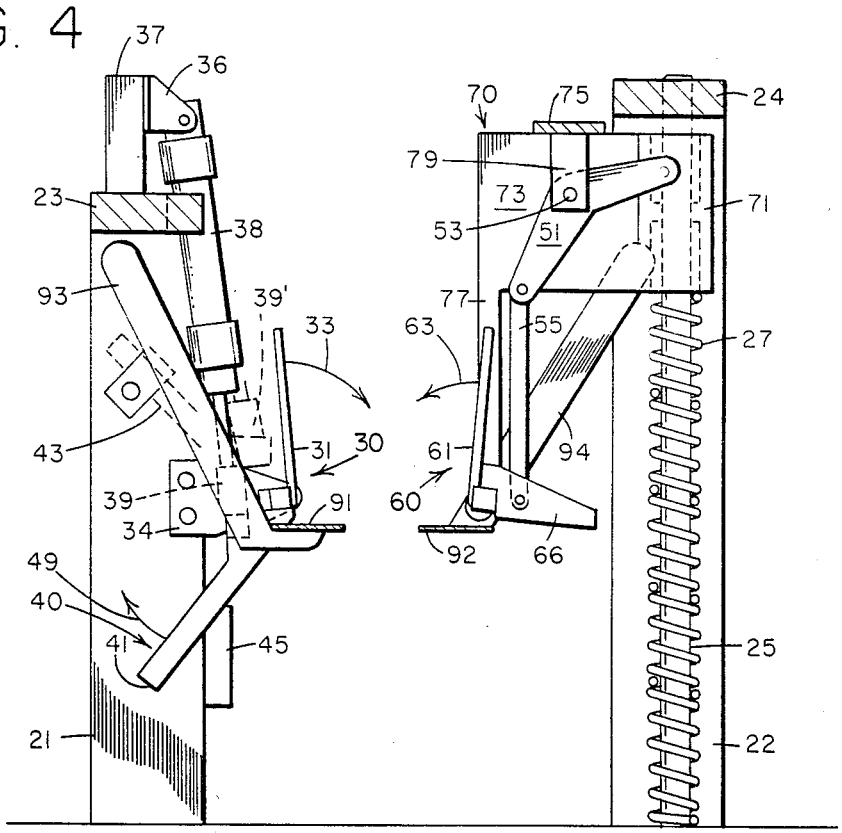
FIG. 4 is a sectional elevation view of the folder-loader assembly, looking in the direction of the arrows 4—4 in FIG. 1, but with the right flipper in standby position.
Figure 7:
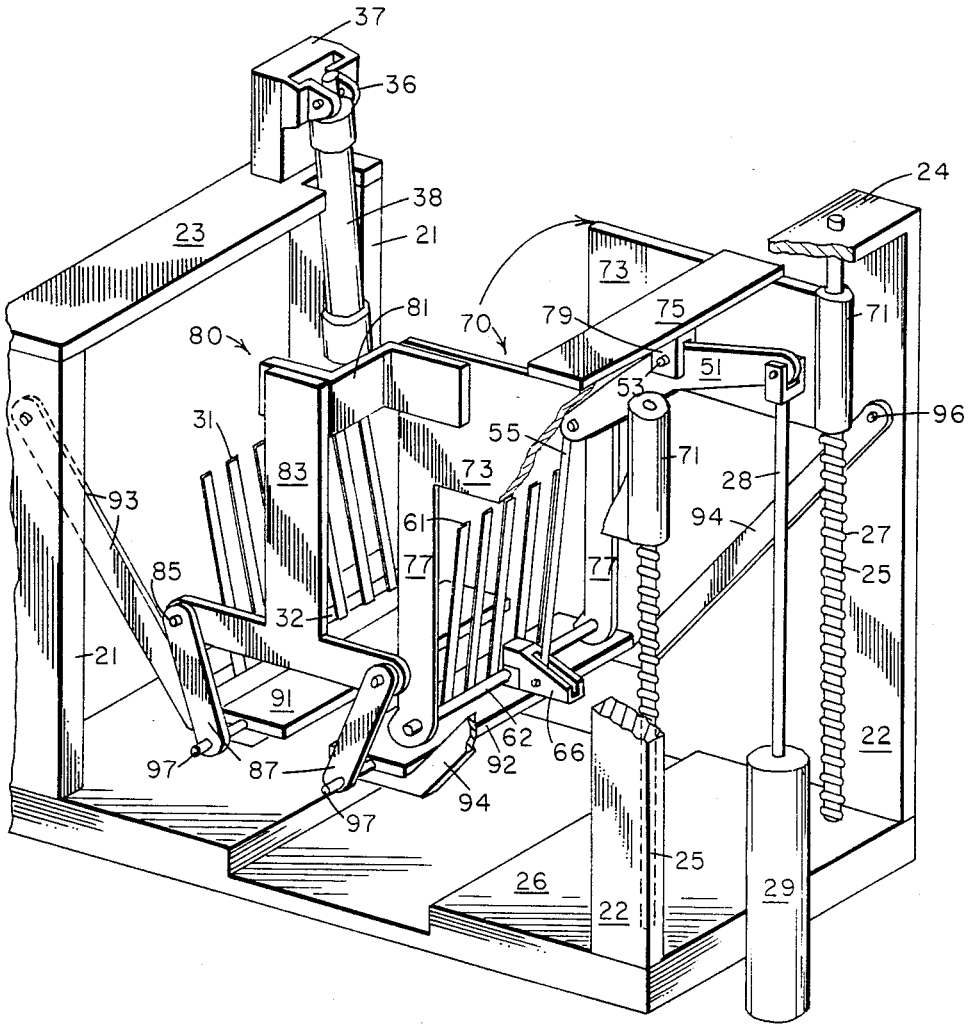
FIG. 7 is an isometric view of the folder-loader assembly from the right-front corner, with parts broken away.
Figure 8:
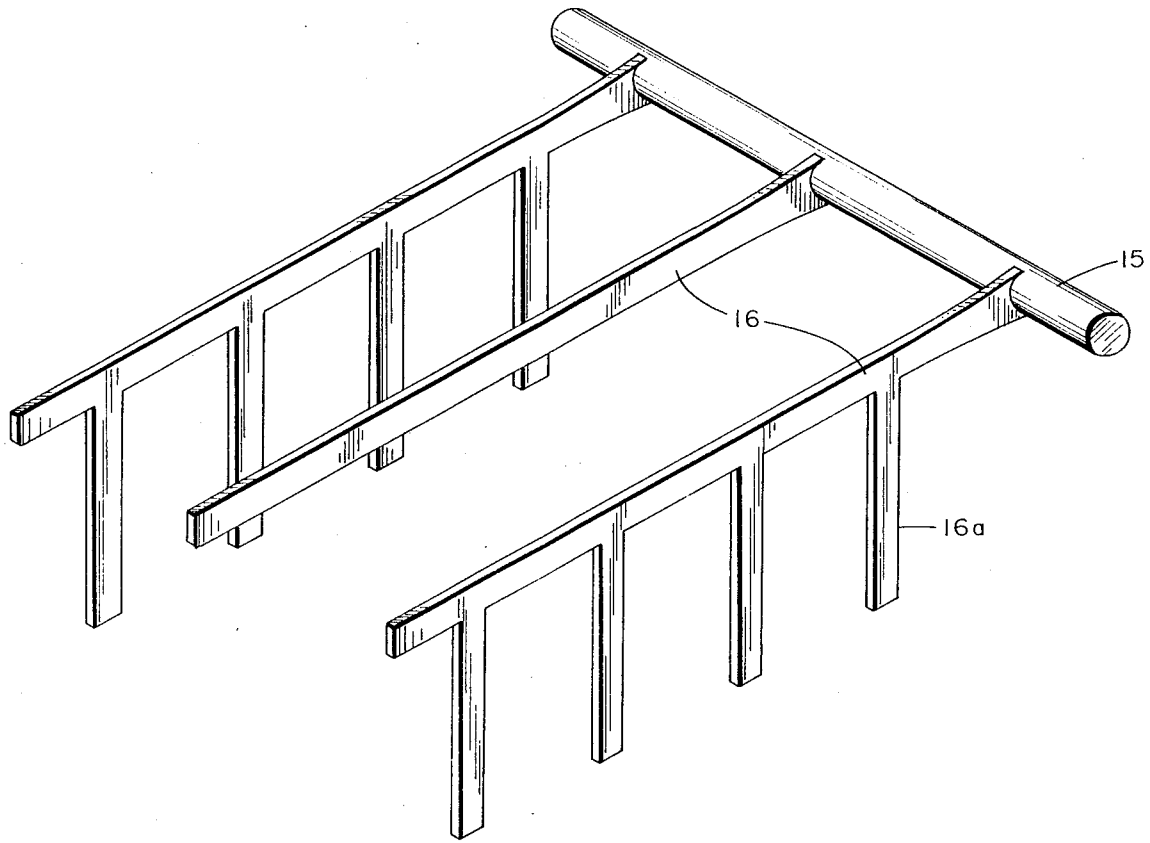
FIG. 8 is a isometric view of the swatter.

Guide rods 25 are also attached to base 26 and to right horizontal support 24, as partially indicated in FIG. 7. Coil springs 27, as seen in FIGS. 2, 4, and 7, encircle guide rods 25 and perform important biasing functions which separate secondary folding, loading, and packing operations, as is described hereinafter. A loading cylinder 29, having a cylinder rod 28, is also attached to base 26 between supports 22.

A left flipper assembly 30, for performing the first folding operation on the left end portion 11 of bag 10, comprises a left flipper having tines 31 and shaft 32, a mounting bracket 34 to which shaft 32 is rotatably attached, and a left flipper cylinder 38 which is attached to left horizontal support 23 with a mounting block 37 and mounting block bracket 36. The rod for cylinder 38 has at its lower end a clevis 39 which is attached to left flipper arm 41.

Arm assembly 40 comprises left flipper arm 41, an upper stop 43 for arm 41, and a lower stop 45 for arm 41. Stops 43 and 45 are rigidly attached to rear left support 21, as seen in FIG. 4, although they are omitted in FIG. 1. Tines 31 revolve in direction 33 to perform their folding movement, while arm 41 revolves in direction 49 from stop 45 to stop 43.

Figure 14:
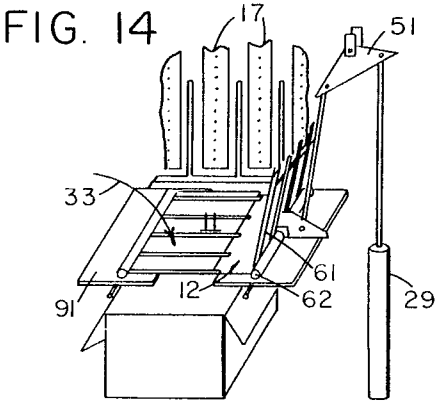
FIG. 14 is a perspective view, similar to FIGS. 12 and 13, which shows the left end portion being folded onto the middle portion by the left flipper.

Left flipper assembly 30 is promptly actuated by cylinder 38 after the swatter has pivotally departed. Its tines 31 pivot in direction 33 and fold end portion 11 onto middle portion 12, as seen in FIG. 14, and then immediately return to upright position.

The second folding operation, the loading operation, and the packing operation are performed by a double-function means for utilizing a singly and linearly applied force in order to perform a pivoting movement and then a linear movement, wherein the pivoting movement accomplishes the second folding operation and the linear movement accomplishes both the loading operation and the packing operation. This double-function means is a combined apparatus which is attached to right vertical supports 22 and/or right horizontal support 24. Specifically, a rocker arm assembly 50, comprising a rocker arm 51, a rocker arm pivot 53, and a right flipper link 55, is pivotally attached to the upper end of cylinder rod 28 so that the right portion of rocker arm 41 is pulled in movement 57 as rod 28 is retracted. Correspondingly, the left portion of rocker arm 51 pivots in direction 59 as rod 28 retracts. This pivoting movement of arm 51 causes right flipper link 55 to move leftwardly and upwardly, as seen in FIG. 5, to position 55'.

Right flipper assembly 60 comprises a right flipper having flipper shaft 62 and tines 61 which are perpendicularly attached to flipper shaft 62, and a right flipper arm 66, having a link stop channel 68 therewithin, which is pivotally attached to the lower end of link 55.

A pair of carriers 70 each comprise a bushing within cylinders 71 for a guide rod 25, a carrier support plate 73 which is rigidly attached to cylinder 71, a carrier support arm 77 which is extended downwardly from the inner end of plate 73 and is rigidly attached thereto, and a carrier tie bar 75 which is rigidly attached to the top edges of plates 73 and maintains them in parallel and rigidly aligned relationship. Carrier assembly 70 further comprises a rocker arm attachment bracket 79 which is rigidly attached to the lower side of carrier tie bar 75 and midway between cylinders 71, as seen best in FIG. 2. Rocker arm pivot 63, supporting rocker arm 51, passes through bracket 79.

Figure 15:
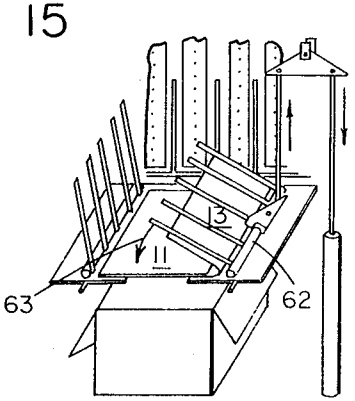
FIG. 15 is a perspective view, similar to FIGS. 12–14, which shows the right end portion being folded onto the left end portion by the right flipper, after the left flipper has returned to its original position.

As best seen in FIG. 5, when cylinder rod 28 is retracted, bringing right end of rocker arm 51 downward in movement 57 and the left end in reverse corresponding movement 59, so that link 55 moves to position 55', right flipper arm 66 pivots to position 66' and prongs 61 pivot in direction 63 to position 61', as seen in FIG. 1 and in phantom in FIG. 5, thereby laying end portion 13 onto end portion 11, as seen in FIGS. 5, 12 and 15.

The sheet-folding assembly has completed its operations at this point in time, except for returning tines 61 to upright position. However, tines 61 and right flipper shaft 62 must first take part in loading and packing each folded bag 14 before returning to upright position, as parts of a folded-sheet loading and packing assembly which additionally comprises a tray actuator bracket assembly 80 and a pair of stacking tray assemblies.

Figure 3:
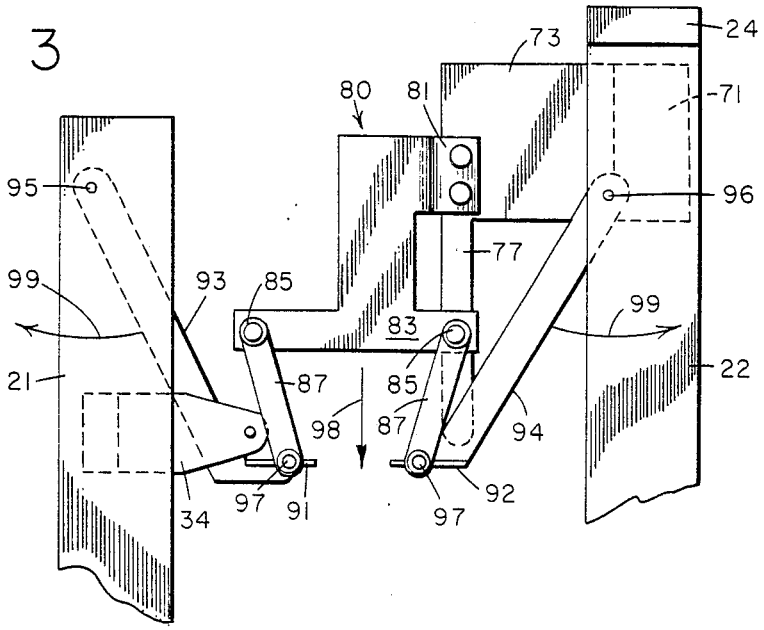
FIG. 3 is a front elevation view of the folder-loader assembly, looking in the direction of the arrows 3—3 in FIG. 1.

Tray actuator bracket assembly 80 comprises a bracket connection 81, a T-member 83, a pair of pivots 85, and a pair of tray links 87, as shown in FIGS. 1 and 3. A pair of stacking tray assemblies comprises left stacking tray 91, right stacking tray 92, a pair of left stacking tray arms 93, a pair of right stacking tray arms 94, left stacking tray arm upper pins 95, right stacking tray arm upper pins 96, and lower stacking tray pins 97. Bracket connection 81 attaches tray actuator bracket assembly 80 to front carrier support plate 73. The pair of pins 85 attach the pair of tray links 87 to T-member 83, and the pair of pins 97 attach links 87 to trays 91,92 to which tray arms 93,94 are rigidly attached. Pins 95,96 respectively attach arms 93,94 to vertical supports 21,22 at both front and back of the frame.

Figure 11:
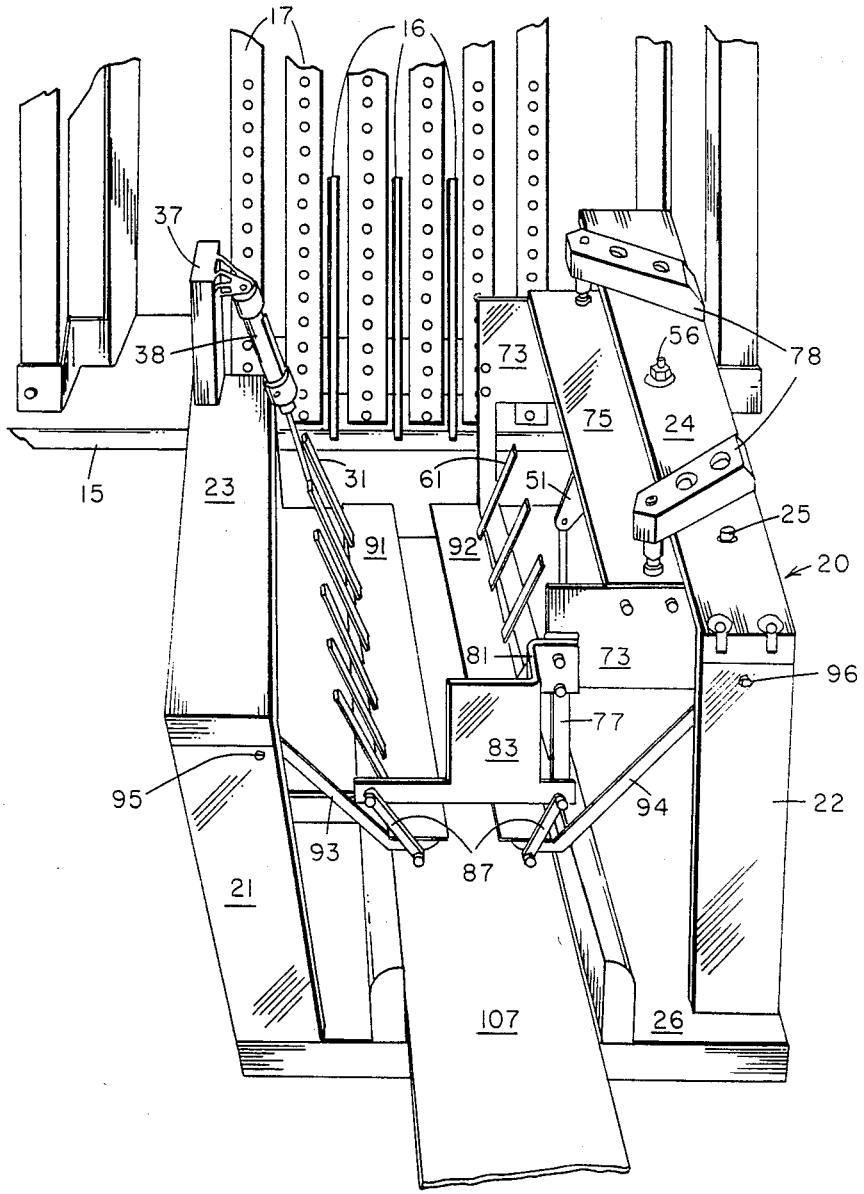
FIG. 11 is a complete front perspective view of the folder-loader assembly and a portion of a machine for making sandwich bags, including vertically disposed conveyor belts and a pivotable swatter for lifting the middle portion of a sandwich bag from the adjacent conveyor.
Figure 16:
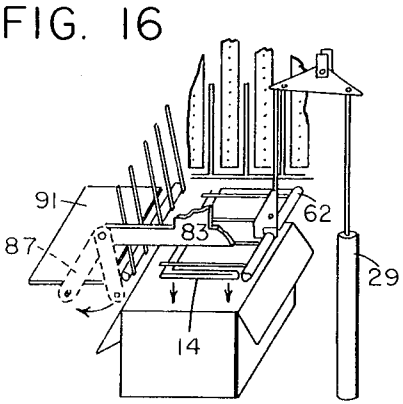
FIG. 16 is a perspective view, similar to FIGS. 12–15, which shows the trays moving sidewardly while the right flipper is propelling the folded bag downwardly into the box.

The folded-sheet loading assembly thereupon begins to operate by sidewardly revolving trays 91,92 in directions 99 and pushing each folded bag 14 toward bottom 101 of box 100 by propelling shaft 62 and tines 61 of the right flipper in direction 98, as shown in FIGS. 5 and 16, until the folded bags 14 are squeezed against bottom 101 with a force controlled by a packing force which equals the force of cylinder 29 less the force of springs 27 plus the weight of rocker arm assembly 50, right flipper assembly 60, carrier assembly 70, tray actuator bracket assembly 80, right stacking tray 92, right stacking tray arms 94, and right stacking tray pins 95,96,97. The sheet folding assembly then upwardly raises shaft 62 and tines 61 and finally pivots tines 61 to upright position, to be ready for delivery of the next bag 10, as seen in FIG. 11.

This combination of folding, loading, and stacking operations is achieved by providing in springs 27 the correct amount of force to support at least the combined weights of the right flipper assembly, the carrier arm assembly, and the rocker arm assembly and additionally to resist the force required for cylinder 29 to pull rocker arm 51 in a clockwise pivotal movement, as seen in FIG. 5, until tines 61 have completed the second folding operation. As further downward movement of rod 28 occurs, cylinder 29 overcomes the force of springs 27 and moves carrier assembly 70 and tray actuator bracket assembly 80 downwardly as a unit until the right flipper propels folded bag 14 onto bottom 101 or onto previously stacked bags 14 with a selected packing force.

Coil springs 27, as the biasing means, are suitably five springs surrounding each guide rod 25. Each spring is suitably 2¼ inches high when uncompressed and 0.46 inch high when fully compressed. The loading is 3.68 pounds per inch of compression. The springs are preloaded by fitting five springs into a total height of 7 inches for rods 25. The total travel distance when packing sandwich bags is four inches which is divided among the five springs on each rod 25. Suitable springs are LC-038G11, sold by the Lee Spring Co.

After the completion of these loading and stacking operations, cylinder 29 extends rod 28, thereby relieving the pressure on springs 27 and allowing the entire unitary combination of right flipper assembly 60, carrier assembly 70, and tray actuator bracket assembly 80 to rise to the level of the folding station, as seen in FIG. 5, as trays 91,92 simultaneously return to restore the platform of the U-shaped channel. Thereafter, as rod 28 continues to move upwardly, the right end of rocker arm 51 pivots counterclockwise and right flipper arm 66 pivots clockwise, as seen from the front of the folder-loader, so that tines 61 also pivot clockwise to come back to approximately upright position, thereby restoring the U-shaped channel of the folder-loader.

The apparatus of this invention is simplified because left flipper assembly 30 is actuated by air cylinder 38, swatter shaft 15 is actuated by a separate cylinder (not shown in the drawings), and all the rest of the motion is accomplished by cylinder 29 acting through a linkage. The right flipper pivots on shaft 62 at the bottom ends of vertical arms 77 of the carrier assembly 70 because carrier cylinders 71 are supported by springs 27 on guide rods 25. When cylinder rod 28 pulls on rocker arm 51, it is trying to pull down the main supports of carrier assembly 70 and tray actuator bracket assembly 80, because rocker arm 51 is pivoted on carrier tie bar 75, but the spring force of springs 27 is sufficiently great that it is easier for rocker arm 51 to pivot. This downward force then pulls flipper link 55 upwardly which in turn pivots flipper 66, causing the right flipper to rotate counterclockwise in direction 63. It is stopped in a horizontal position when right flipper link 55 strikes link stop channel 68.

Then, as cylinder 29 continues to pull downwardly, it overcomes the force of springs 27 and moves carrier assembly 70 and bracket assembly 80 downwardly, causing arms 93,94 to pivot and trays 91,92 to revolve downwardly and outwardly to the sides, so that relative to folded bag 14, trays 91,92 simply move sidewardly out of the way as the right flipper and bag 14 are propelled in direction 98 toward bottom 101 of carton 100. There is sufficient travel distance available in direction 98 for each folded bag 14 to be pressed against bottom 101 or against previously stacked bags 14 with the full packing force to effectuate stacking of the bags into carton 100.

Because link stop channel 68 remains in contact with right flipper link 55 after the downward movement begins and until the right flipper returns to the folding station, the right flipper is held in its horizontal position during its up-and-down vertical travel. Stops 78 on support 24 are adjusted for accurately positioning tines 61 in standby or article-receiving position, slightly outwardly of vertical, after completion of the return movement of cylinder rod 28.

As seen in FIGS. 1–17, the folding station comprises trays 91,92 and left and right flipper tines 31,61. The folding means comprises left and right flipper assemblies 30,60, left flipper arm assembly 40, and rocker arm assembly 50.

The propulsion means comprises loading cylinder 29 and loading cylinder rod 28. The fixed part of the support and guide means comprises vertical supports 21,22, horizontal supports 23,24, guide rods 25, and base 26. The movable part of the support and guide means comprises carrier assembly 70 and tray actuator bracket assembly 80. Carrier assembly 70, bracket assembly 80, rocker arm assembly 50, and right flipper assembly 60 (while the right flipper is horizontal) can be collectively described, on a functional basis, as a "stomper" apparatus. The guides utilized by the movable part are guide rods 25 which are acted upon by the bushings within carrier cylinders 71.

What is claimed is:

1. A method for sequentially folding, loading and packing a plurality of thin, limp, sheet-type articles into a receptacle, comprising the following steps:

A. sequentially delivering each article of said plurality of aritcles to a folding station having a removable article support platform which supports an article at said station, and a folding member in standby position, said folding member in said standby position being adapted to engage with at least one portion of said article for folding said one portion to overlie another portion of said article;

B. folding said article by moving said folding member about a pivot axis from said standby position to a folding position, where said one portion is folded to overlie said another portion, thereby folding said article at least once producing a folded article, said folded article being spaced from and aligned with the bottom of a receptacle therefor while supported by said platform;

C. loading and packing said folded article by removing said platform from said folding station and from supporting said folded article and simultaneously propelling said folding member, including the pivot axis thereof, toward said bottom and into said receptacle to push and pack said folded article toward said bottom while said folding member is in its folding position; and D. returning said folding member including the pivot axis thereof to said folding station and to said standby position and, returning said platform to said folding station so that it can receive and support another article to be folded.

2. The method of claim 1, wherein said article is folded by applying a force from a force source to said folding member to pivot said folding member from said standby position to said folding position wherein said article is thereafter propelled by said folding member, actuated by said force originating from said force source, toward said bottom.

3. The method of claim 1, wherein said article is packed toward said bottom with a selected packing force upon said folding member.

4. The method of claim 1, wherein said folding member is a second folding member and said article is folded by a first folding member before being folded by said second folding member in step B.

5. The method of claim 1, wherein said platform is in two parts which are sidewardly removed in opposite directions.

6. The method of claim 1, wherein said article is delivered to said folding station in a partially folded condition.

7. A method for sequentially folding, loading and packing a plurality of thin, limp, sheet-type articles into a receptacle having a bottom, comprising the following steps:

A. delivering each said article in sequence to a pick-up location and picking up each said article thereat by pivotal means which during a pivotal movement engages with a middle portion of each said article to move the same causing a partial folding of each said article along two parallel fold lines, whereby said article is divided into a first end portion, said middle portion having two side edges and said fold lines has two end edges, and a second end portion, the side edges of said middle portion revolving in parallel to an axis of said pivotal movement;

B. depositing said partially folded picked-up article by said pivotal means onto supports of a folding station which is disposed in parallel to said bottom of said receptacle;

C. completely folding said first end portion onto said middle portion by pivoting a folding member about a pivot axis from a first standby position to a folding position, thereafter returning said folding member to said standby position;

D. completely folding said second end portion onto said first end portion to form a folded article which is spaced from, parallel to and aligned with said bottom of said receptacle by pivoting a second folding member about a second pivot axis from a standby position to a folding position; and E. loading and packing said folded article by removing said supports and propelling said second folding member including said second pivot axis toward said bottom while said second folding member is in said folding position.

8. The method of claim 7, wherein said article is packed toward said bottom with a selected packing force upon said folding member.

9. The method of claim 7, wherein said article is folded by applying a force from a force source to said second folding member to pivot said second folding member from a standby position to a folding position wherein said article is thereafter propelled by said folding member, actuated by said force originating from said force source, toward said bottom.

10. The method of claim 7, wherein said folded article which is propelled into said receptacle in step E is additionally pushed into sequentially close proximity with said bottom.

11. The method of claim 7, wherein said receptacle comprises four sides and said supports comprise at least one tray which moves sidewardly beyond at least one side of said four sides in step E of claim 6.

12. The method of claim 7, wherein said article is resting on a conveyor when said pivotal movement begins.

13. The method of claim 12, wherein said pivotal movement begins by picking up said middle portion from said conveyor by said pivotal means while supporting said middle portion along at least said two fold lines, whereby said first and second ends portions trail behind said middle portion during said pivotal movement to accomplish said partial folding.

14. The method of claim 13, wherein said first and second end portions are disposed in approximately perpendicular relationship to said middle portion when said depositing occurs.

15. The method of claim 14, wherein said pivotal movement occurs through an arc of approximatley 180°.

16. The method of claim 15, wherein said conveyor is dispoded in approximately parallel relationship to said supports.

17. The method of claim 14, wherein said pivotal movement occurs through an arc of approximately 90°.

18. The method of claim 17, wherein said conveyor is disposed in approximately perpendicular relationship to said supports.

19. The method of claim 18, whrein each said article is held approximately parallel to said conveyor by vacuum until said pivotal movement begins to occur.

20. The method of claim 18, wherein said second end portion is held in said perpendicular relationship to said middle portion by vacuum until said folding of step D begins to occur.

21. The method of claim 20, wherein said first end portion is additionally held in said perpendicular relationship by vacuum until said folding of step C begins to occur.

* * * * *